US010981178B2

(12) United States Patent
Britto

(10) Patent No.: US 10,981,178 B2
(45) Date of Patent: Apr. 20, 2021

(54) SELF-CLEANING GARBAGE DISPOSAL SYSTEM, AND METHOD OF OPERATION

(71) Applicant: Kirk Britto, Sarasota, FL (US)

(72) Inventor: Kirk Britto, Sarasota, FL (US)

( * ) Notice: Subject to any disclaimer, the term of this patent is extended or adjusted under 35 U.S.C. 154(b) by 148 days.

(21) Appl. No.: 16/022,112

(22) Filed: Jun. 28, 2018

(65) Prior Publication Data

US 2019/0003166 A1 Jan. 3, 2019

Related U.S. Application Data

(60) Provisional application No. 62/527,173, filed on Jun. 30, 2017.

(51) Int. Cl.

| | |
|---|---|
| ***B02C 23/36*** | (2006.01) |
| ***E03C 1/266*** | (2006.01) |
| ***A47L 15/42*** | (2006.01) |
| ***B02C 23/18*** | (2006.01) |
| ***B02C 18/12*** | (2006.01) |
| ***B02C 18/00*** | (2006.01) |

(52) U.S. Cl.

CPC ..... *B02C 23/36* (2013.01); *A47L 15/4223* (2013.01); *B02C 18/0084* (2013.01); *B02C 18/0092* (2013.01); *B02C 18/12* (2013.01); *B02C 23/18* (2013.01); *E03C 1/2665* (2013.01); *B02C 2201/06* (2013.01)

(58) Field of Classification Search

CPC .. B02C 18/0092; B02C 18/0084; B02C 23/18
USPC ..... 241/46.012, 46.013
See application file for complete search history.

(56) References Cited

U.S. PATENT DOCUMENTS

| | | | | |
|---|---|---|---|---|
| 2,655,966 | A | 10/1953 | Russell | |
| 2,760,730 | A | 8/1956 | Jordan | |
| 2,880,941 | A | 4/1959 | Fox et al. | |
| 3,034,734 | A | 5/1962 | Guth | |
| 3,545,684 | A | 12/1970 | Ruspino | |
| 3,788,564 | A | 1/1974 | Kokorzycki | |
| 5,236,137 | A | 8/1993 | Coogan | |
| 5,249,749 | A | 10/1993 | Krebsbach | |
| 5,308,000 | A | 5/1994 | Riley | |
| 5,539,166 | A * | 7/1996 | Reier | E03C 1/2665 200/81 H |
| 5,577,673 | A | 11/1996 | McMurphy et al. | |
| 5,676,319 | A | 10/1997 | Stiggins et al. | |

(Continued)

*Primary Examiner* — Faye Francis

(74) *Attorney, Agent, or Firm* — John Rizvi; John Rizvi. P.A.—The Patent Professor®

(57) ABSTRACT

A self-cleaning garbage disposal system is provided including a container having a neck portion leading to a container opening and a flow switch valve for connecting the container to a dishwasher drain hose. The flow switch valve is switchable to an open position to allow dishwasher water to be fed to the container from the dishwasher drain hose and to a closed position to not allow dishwasher water to be fed to the container from the dishwasher drain hose based on a rotational position. The garbage disposal system can include a garbage disposal cap to be rotationally inserted into the container opening, and the flow switch valve operation can respond to the rotational position of the garbage disposal cap. Sensors can be provided on the garbage disposal cap and the neck portion of the container to detect the rotational position of the garbage disposal cap.

16 Claims, 6 Drawing Sheets

(56) References Cited

U.S. PATENT DOCUMENTS

| | | | | |
|---|---|---|---|---|
| 7,066,415 | B2 * | 6/2006 | Strutz | B02C 25/00 241/101.3 |
| 7,500,626 | B2 * | 3/2009 | Berger | E03C 1/2665 241/32.5 |
| 8,033,486 | B2 * | 10/2011 | Berger | E03C 1/122 137/247.27 |
| 8,819,872 | B2 | 9/2014 | Bradley et al. | |
| 9,145,666 | B2 * | 9/2015 | Hammer | B02C 18/0092 |
| 9,696,728 | B2 * | 7/2017 | Gormley | G05D 7/0635 |
| 9,752,307 | B2 * | 9/2017 | Bewley, Jr. | E03C 1/2665 |
| 9,968,940 | B2 * | 5/2018 | Hartmann | H02J 5/005 |
| 10,035,150 | B2 * | 7/2018 | Gormley | B02C 23/18 |
| 10,799,879 | B2 * | 10/2020 | Liu | B02C 18/0084 |
| 2014/0070036 | A1 | 3/2014 | Hammer | |

* cited by examiner

SELF-CLEANING GARBAGE DISPOSAL SYSTEM, AND METHOD OF OPERATION

CROSS-REFERENCE TO RELATED APPLICATIONS

This application claims the benefit of U.S. Provisional Patent Application Ser. No. 62/527,173, filed on Jun. 30, 2017, which is incorporated by reference herein in its entirety.

FIELD OF THE INVENTION

The present invention relates generally to kitchen devices and accessories, and more particularly, to a garbage disposal system that can automatically conduct self-cleaning via dishwasher drain water and/or dish detergent on a dishwasher drain cycle.

BACKGROUND OF THE INVENTION

Garbage disposals, also called disposers, have been popular for many decades in the United States. These devices are typically cone-shaped units containing a cutting device on the inside, that are attached to the drain under a kitchen sink, so that larger pieces of food waste entering the disposal opening are reduced to smaller particles to help propel them through the drain and into the city sewer system for ultimate removal. They provide an effective way of reducing household waste as food scraps generally account for 10-20% of household waste. They also help to keep the kitchen as well as the house as a whole cleaner as smaller amounts of food waste will be disposed to and maintained in the kitchen trash can. Food waste, when kept in the trash can for a prolonged period of time, can become decomposed, which not only produces an unpleasant smell and attracts insects, but also can cause health problems. In addition, food waste when disposed together with other municipal waste can create environmental problems. For example, the high water content of food scraps means that it consumes more energy to heat and burn them. Food scraps, when buried in landfills, will decompose and generate methane gas, which is a greenhouse gas that can contribute to the greenhouse effect causing global warming.

As the food garbage is processed down the drain, the theory is to have the larger pieces cut into smaller pieces for disposal. However, sometimes larger cuttings of waste remain and may not be pushed out of the drain, instead becoming trapped in the cutting apparatus of the garbage disposal. Some of the food residues may also become attached to the inner wall of the garbage disposal and/or the drain pipe. If this goes unnoticed, the food particles or residues will start to emit an unpleasant odor and also decrease the effectiveness of the garbage disposal by clogging it. Sometimes, the operator shuts off the garbage disposal prior to its tasks being fully complete. This can also cause a residue buildup, leading to clogging and odors.

In addition to making sure that the garbage disposal and water are run for a proper long time, a remedy for the odor is to manually use a spray deodorant to mask the smell from the sink, after the operation ceases. A method for dislodging the food particles from the grinding chamber can be to fix a separate spray attachment inside the garbage disposal so as to add more water directly into the grinding chamber during operation, reducing the buildup of the wastes. Another way to clean a garbage disposal or solve the odor problem is to buy disposal cleaning products, and then pour them down the garbage disposal and run the garbage disposal. These chemical cleaning agents would then remove the residues that attached to the blades and the inner wall.

Problems with manually treating the odors or cleaning the garbage disposal involve trying to remember to do these tasks but forgetting to do them on a regular basis. This will result in a gradual buildup which is harder to clean. It also may involve the application of hazardous chemicals, which can remain inside the drain for an extended period of time, creating potential health issues. The larger drawback is that the current ways of masking the odor or cleaning the garbage disposal with cleaning products treat only the symptom of the problem, not the cause. It is more important to remove the food buildup from the grinding chamber, or to not allow it to be built up in the first place. As to preventing a buildup in the first place, it can be difficult to add a separate line to cleanse the grinding chamber.

Accordingly, there is an established need for a solution to at least one of the aforementioned problems, and most particularly to facilitate cleaning of the garbage disposal on a regular basis in a manner that is convenient to the user.

SUMMARY OF THE INVENTION

The present invention is directed to a convenient self-cleaning garbage disposal system that is capable of conducting self-cleaning automatically on a dishwasher drain cycle. This allows the garbage disposal to run with very hot temperature water (e.g., 130-140° F.) from the dishwasher drain cycle, which is greatly capable of cleaning and pressurizing the disposal cavity to eliminate odor and remove food buildup. Dishwasher detergent contained in the dishwasher drained water also helps in cleaning the garbage disposal system. The garbage disposal system of the present invention can also run on a normal basis, i.e., with no water feed from the dishwasher. The garbage disposal system can include a user-operable control for the user to select the operation mode (dishwasher water vs. normal). The present invention can be retro-fitted to an existing garbage disposal system or can be sold as an entirely new product to replace an old garbage disposal system.

Introducing a first embodiment of the invention, the present invention consists of a self-cleaning garbage disposal system, comprising a container having a container opening, and an electrically-operated cutting device housed in an internal space of the container and configured to cut waste entering the internal space through the container opening. The garbage disposal system further includes a flow switch valve operable to selectively allow or prevent fluid communication from a dishwasher drain hose to an inlet of the container. The flow switch valve is selectively and reversibly switchable to an open position allowing dishwasher water to be fed to the inlet of the container from the dishwasher drain hose and to a closed position to prevent dishwasher water from being fed to the inlet of the container from the dishwasher drain hose.

In a second aspect, the container can include a neck portion at which the container opening is located.

In another aspect, the garbage disposal system can further include a garbage disposal cap configured to be inserted into the container opening.

In another aspect, the electrically-operated cutting device can be configured to switch on and off in dependence of a position of the garbage disposal cap relative to the container opening.

In another aspect, the garbage disposal cap can be configured to allow water and waste to pass therethrough and into the internal space of the container when the garbage disposal cap is inserted into the container opening.

In another aspect, the garbage disposal system can further include a user-operable switch for operating the flow switch valve.

In another aspect, the user-operable switch can further operate the electrically-operated cutting device.

In another aspect, the user-operable switch can be provided by the garbage disposal cap.

In another aspect, the flow switch valve can be switchable responsively to a rotational position of the garbage disposal cap within the container opening.

In another aspect, the flow switch valve can be switched to the open position responsively to the garbage disposal cap adopting a first rotational position relative to the container opening.

In another aspect, the flow switch valve can be switched to the closed position responsively to the garbage disposal cap adopting a second rotational position relative to the container opening, wherein the second rotational position is different to the first rotational position.

In another aspect, the garbage disposal system can further include at least one sensor unit configured to detect the rotational position of the garbage disposal cap within the container opening.

In another aspect, the at least one sensor unit can include a first sensor portion located in the garbage disposal cap and a second sensor portion located in an area of the container adjacent to the container opening. The first sensor portion is configured to mate with the second sensor portion to switch the flow switch valve.

In another aspect, the first sensor portion and the second sensor portion can be configured to switch the flow switch valve when the first and second portions are placed adjacent to one another.

In another aspect, the container can include a neck portion at which the container opening is located, and the second sensor portion can be located in the neck portion of the container.

In another aspect, the flow switch valve can be normally in the closed position.

In another aspect, the garbage disposal system can be configured to adopt a first working configuration in which the electrically-operated cutting device is switched to a cutting state and the flow switch valve is simultaneously in the open position. In this first configuration, fluid communication is allowed from the dishwasher drain hose, through the inlet of the container, along the electrically-operated cutting device and outwardly of the container through an outlet of the container.

In another aspect, the garbage disposal system can be configured to adopt a second working configuration in which the electrically-operated cutting device is switched to a cutting state and the flow switch valve is simultaneously in the closed position. In this second working configuration, fluid communication is allowed form the container opening, through the internal space of the container, along the electrically-operated cutting device and outwardly of the container through an outlet of the container.

In another implementation of the invention, a method of operating a self-cleaning garbage disposal system comprises the steps of:

providing a self-cleaning garbage disposal system including a container having a container opening, an electrically-operated cutting device housed in an internal space of the container and configured to cut waste entering the internal space through the container opening, and a flow switch valve operable to selectively allow or prevent fluid communication from a dishwasher drain hose to an inlet of the container;

connecting the flow switch valve to a dishwasher drain hose; and switching the flow switch valve to an open position allowing the passing therethrough of water from the dishwasher drain hose to the internal space of the container via the inlet of the container.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a convenient self-cleaning garbage disposal system that is capable of conducting self-cleaning automatically in conjunction with a dishwasher drain cycle so as to eliminate odors and prevent buildup from being formed in the garbage disposal system.

Figure 1:
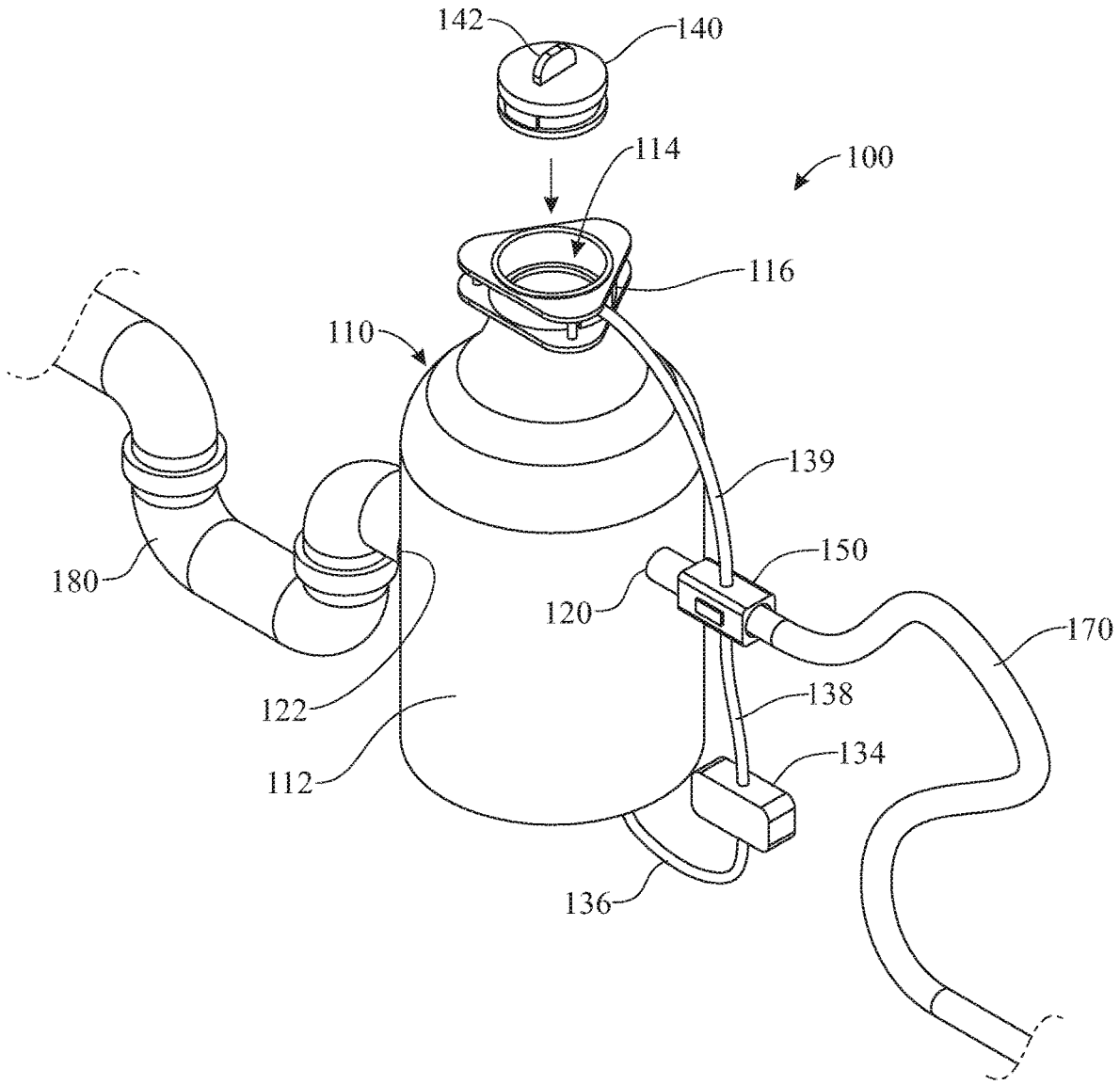
FIG. 1 presents a perspective view showing an exemplary embodiment of the garbage disposal system of the present invention, the garbage disposal cap shown detached.
Figure 4:
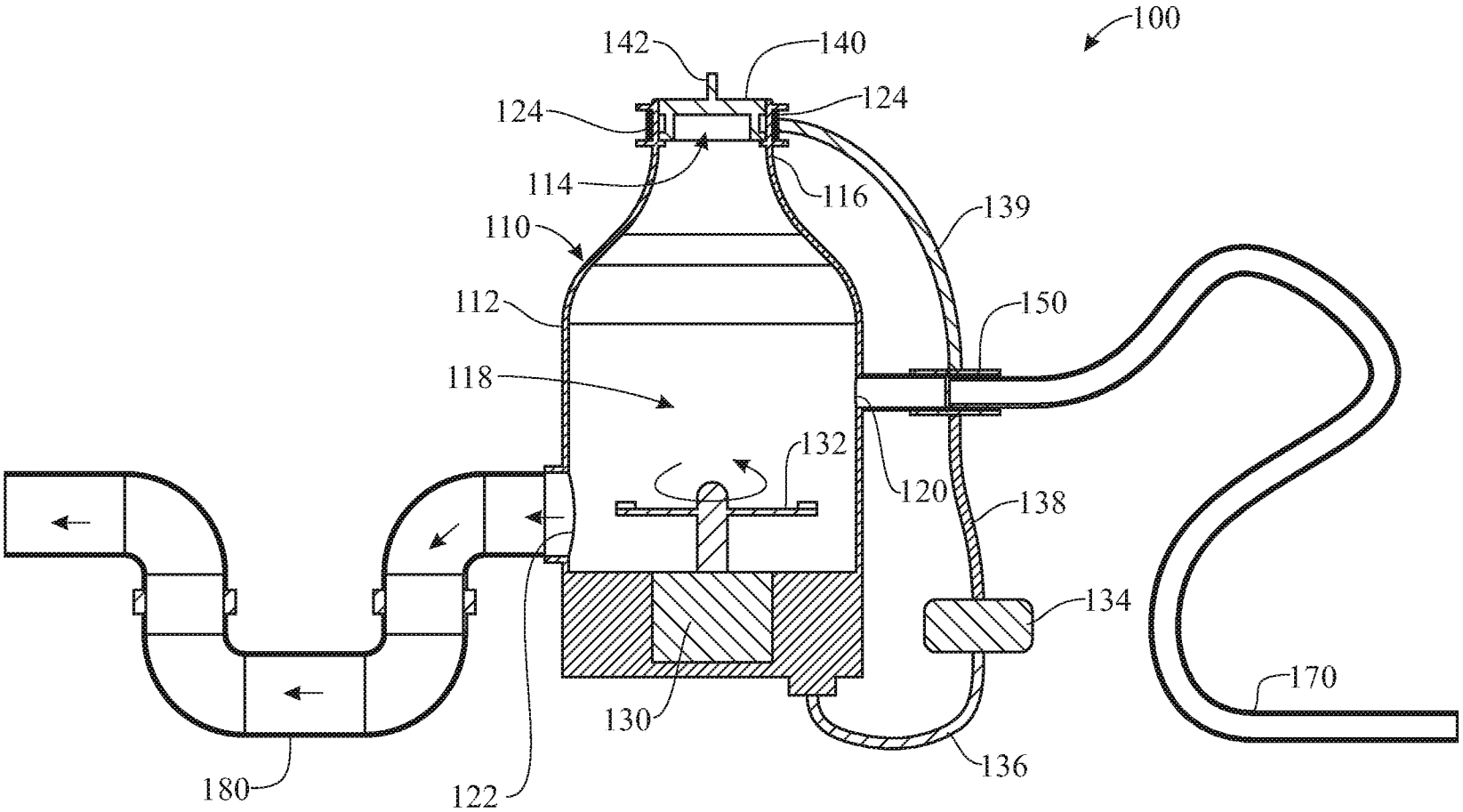
FIG. 4 presents a cross-sectional front elevation view of the garbage disposal system of FIG. 1, in the first operational position of FIG. 2, further revealing that the flow switch valve is closed, and the motor is in operation.
Figure 5:
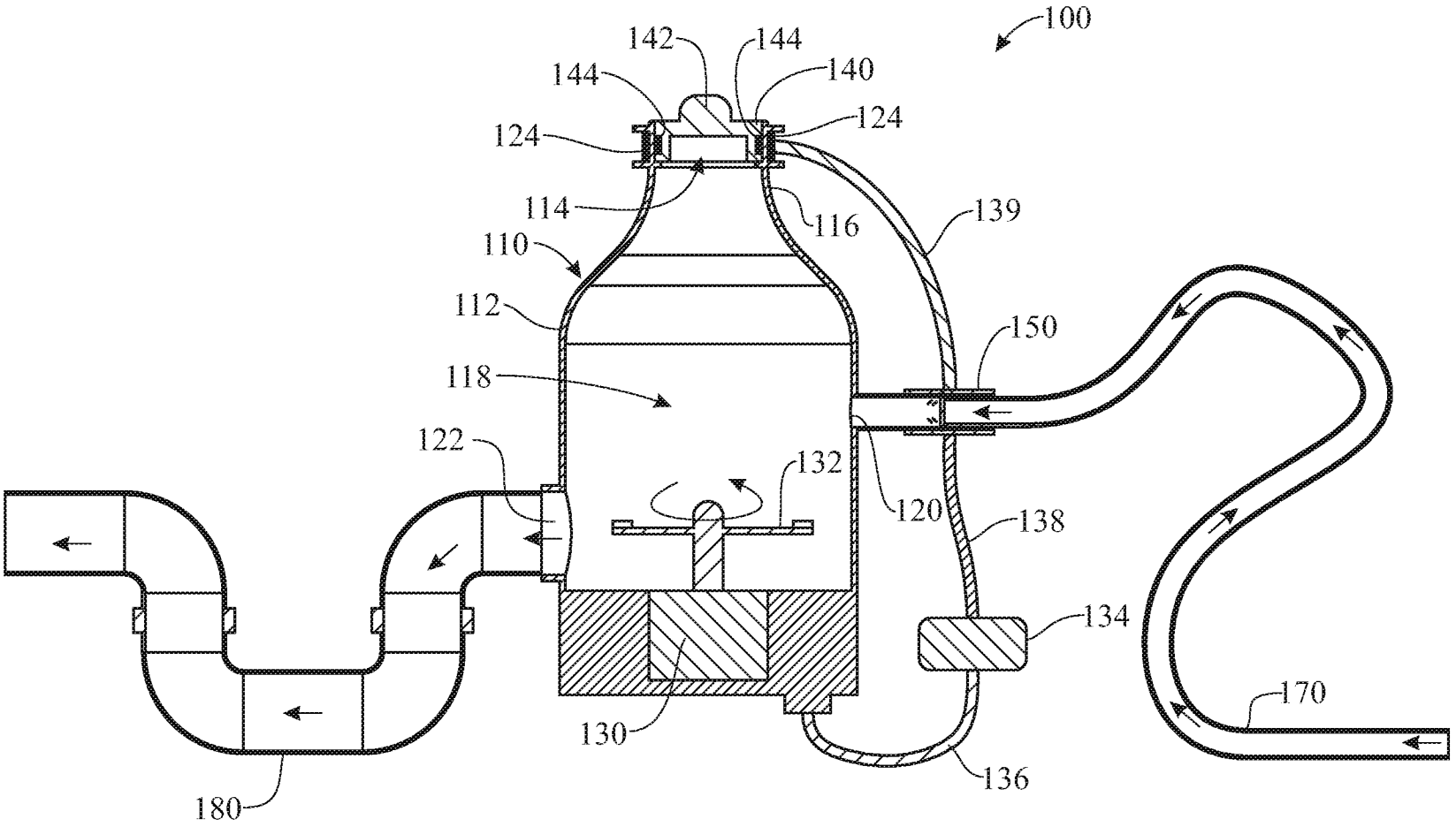
FIG. 5 presents a cross-sectional front elevation view of the garbage disposal system of FIG. 1, in the second operational position of FIG. 3, further revealing that the flow switch valve is opened, and the motor is in operation.

Referring initially to FIG. 1, a self-cleaning garbage disposal system 100 is illustrated in accordance with an exemplary embodiment of the present invention. As shown, the garbage disposal system 100 includes a container 110 having a container body 112, a top container opening 114 and a neck portion 116 extending upward from the container body 112 and leading to the container opening 114. As best shown in FIGS. 4 and 5, the container body 112 has an internal space 118 extending downward from the container opening 114. With continued reference to FIGS. 4 and 5, a first side opening or inlet 120 and a second side opening or outlet 122 are provided on the container body 112, and more particularly, on a sidewall thereof, for purposes that will be hereinafter explained. As shown, the inlet 120 is arranged higher than the outlet 122. The outlet 122 is, in turn, arranged near a bottom of the internal space 118.

As further shown in FIG. 4, the garbage disposal system 100 additionally includes a motor 130 connected to a cutting device 132. The cutting device 132 is arranged within the internal space 118 of the container body 112 and is operable by the motor 130 to cut relatively large portions of solid waste falling into the internal space 118 through the container opening 114. The motor 130 can be arranged, for instance, in a bottom of the container body 112, as shown in FIG. 4. The garbage disposal system 100 further includes or is connected to a power supply 134 for supplying power to the motor 130 of the garbage disposal system 100 via an electrical wiring 136. The power supply 134 has been schematically depicted as a rectangle and can take the form of, for instance and without limitation, a 110 V or 220 V wall outlet to which a wall plug (not shown) carried by the electrical wiring 136 is attached.

As shown in FIG. 1, a garbage disposal cap 140 is shaped and sized to be inserted into the container opening 114 and substantially be retained in the container opening 114. Though not specifically shown, the garbage disposal cap 140 can have holes for the passing of water and optionally waste therethrough from outside the container body 112 to the internal space 118 of the container body 112. The garbage disposal cap 140 fits substantially snugly into the container opening 114 and can be placed in different rotational positions within the container opening 114. To rotate the garbage disposal cap 140, a user can grasp a gripping portion 142 of the garbage disposal cap 140 and apply a clockwise or counterclockwise rotation force; in some embodiments, the garbage disposal cap 140 is rotatable in any of the two directions.

The garbage disposal system 100 further includes at least one sensor for detecting the rotational position of the garbage disposal cap 140 in relation to the container opening 114 and neck portion 116 of the container body 112. For instance and without limitation, as shown in FIGS. 4 and 5, the sensor can be comprised of at least one magnetic or reed switch 124 (the present embodiment including, specifically, two reed switches 124) on the neck portion 116 of the container body 112, and at least one corresponding magnet 144 (the present embodiment specifically including two magnets 144) in the garbage disposal cap 140, as shown in FIG. 5. The magnets 144 of the garbage disposal cap 140 are configured to face, and thus activate the reed switches 124 of the neck portion 116 when the garbage disposal cap 140 adopts a specific rotational position in relation to the neck portion 116, as will be explained in greater detail hereinafter. Alternatively or additionally to the reed switch and magnet sensors described heretofore, the garbage disposal system 100 can include at least one proximity switch or any other kind of sensor for detecting the rotational position of the garbage disposal cap 140 in relation to the container body 112.

The garbage disposal system 100 depicted herein further includes a flow switch valve 150 for selectively providing or preventing fluid communication between the internal space 118 of the container body 112 of the container 110 and a dishwasher drain tube or hose 170. The flow switch valve 150 is powered by the power supply 134 via an electrical wiring 138, and is connected to the sensors (e.g., reed switches 124) on the neck portion 116 of the container body 112 via an electrical wiring 139. The flow switch valve 150 is thus capable of sensing the rotational position of the garbage disposal cap 140. In dependence of the rotational position of the garbage disposal cap 140, the flow switch valve 150 can switch to a closed position or an opened position, for purposes that will be explained in greater detail hereinafter. Thus, a user can switch the flow switch valve 150 by operating (rotating) the garbage disposal cap 140. Alternative embodiments are contemplated in which the garbage disposal system 100 can include a different type of switch for operating the flow switch valve 150; for instance, an externally user-operable on/off switch may be electrically connected to the flow switch valve 150 and allow a user to switch the flow switch valve 150 between the closed position and the opened position.

Installation of the garbage disposal system 100 described heretofore can be carried out, for instance, by connecting the container 110 underneath a sink, so that a sink drain opening (not shown) is in fluid communication with the container opening 114, and water and waste falling through the sink drain opening can fall into the internal space 118 of the container body 112. In turn, the dishwasher drain hose 170 is connected to a dishwasher (not shown) and to the flow switch valve 150. A drain pipe 180 is in turn connected to the outlet 122 of the container body 112. The garbage disposal system 100 is powered via the power supply 134. The garbage disposal cap 140 can be inserted into or removed from the container opening 114 via the sink drain opening.

Referring now to FIGS. 2 through 5, different rotational positions of the garbage disposal cap 140 and corresponding positions (closed or opened) of the flow switch valve 150 are illustrated.

Figure 2:
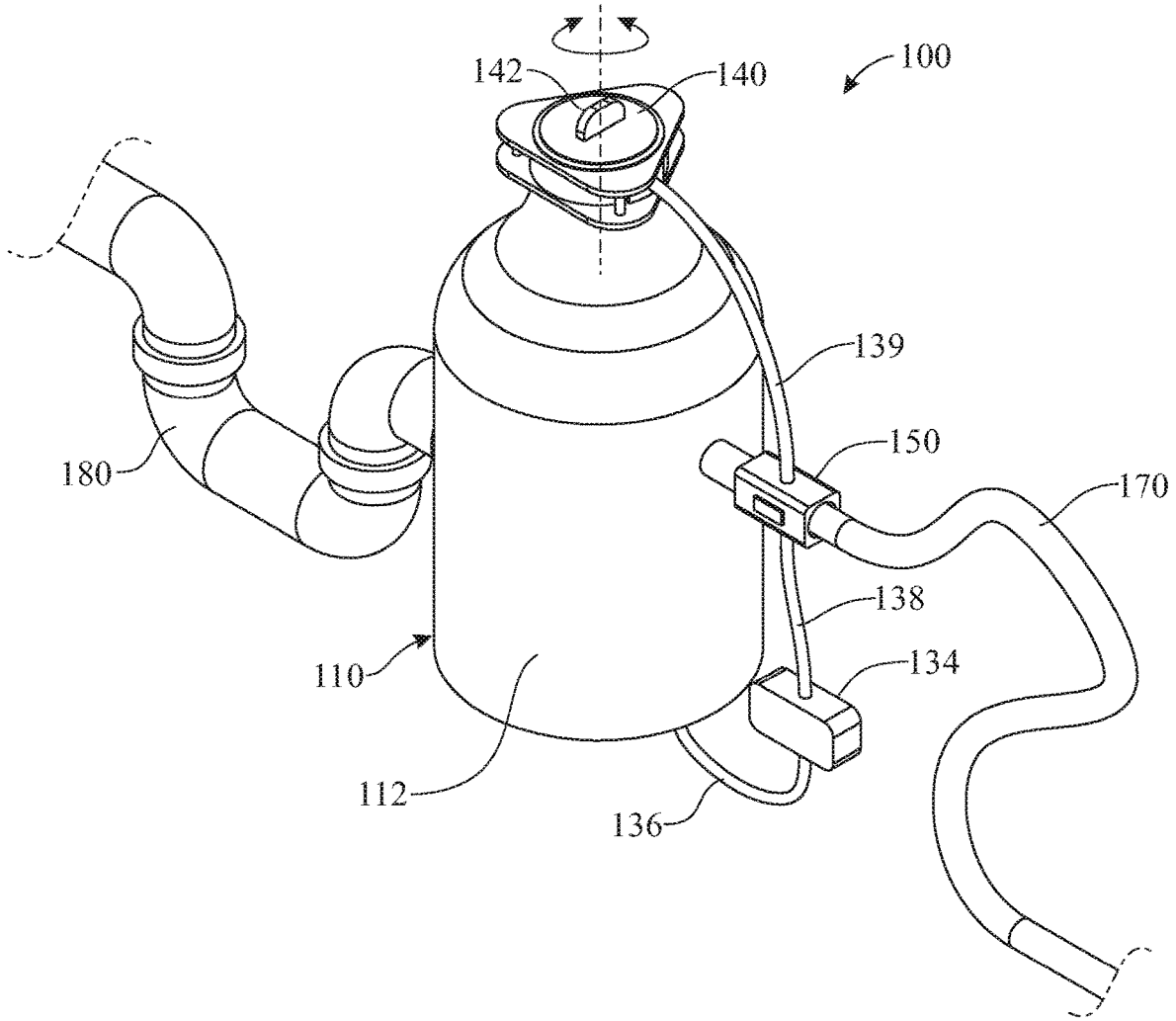
FIG. 2 presents a perspective view of the garbage disposal system of FIG. 1 in a first operational position in which the cap is arranged in a first rotational position.

The illustrations of FIGS. 2 and 4 show the garbage disposal system 100 in a first operational position in which the garbage disposal cap 140 is inserted into the container opening 114 and placed in a first rotational position relative to the container 110 in which the magnets 144 (FIG. 5) on the garbage disposal cap 140 do not face the corresponding reed switches 124 of the neck portion 116 of the container body 112 (the magnets 144 therefore not being visible in FIG. 4). In this position, the flow switch valve 150 is correspondingly closed, as best shown in FIG. 4, preventing fluid communication between the dishwasher drain hose 170 and the inlet 120 of the container body 112. In this first operational position, the motor 130 can be switched on, as shown, to process food residues using water from the sink. As indicated by the arrows in FIG. 4, in the first operational position, the garbage disposal system 100 runs on a normal basis with no water feed from the dishwasher; water from the sink along with processed food residues drains out of the container 110 through the outlet 122 and the garbage disposal system drain pipe 180.

Figure 3:
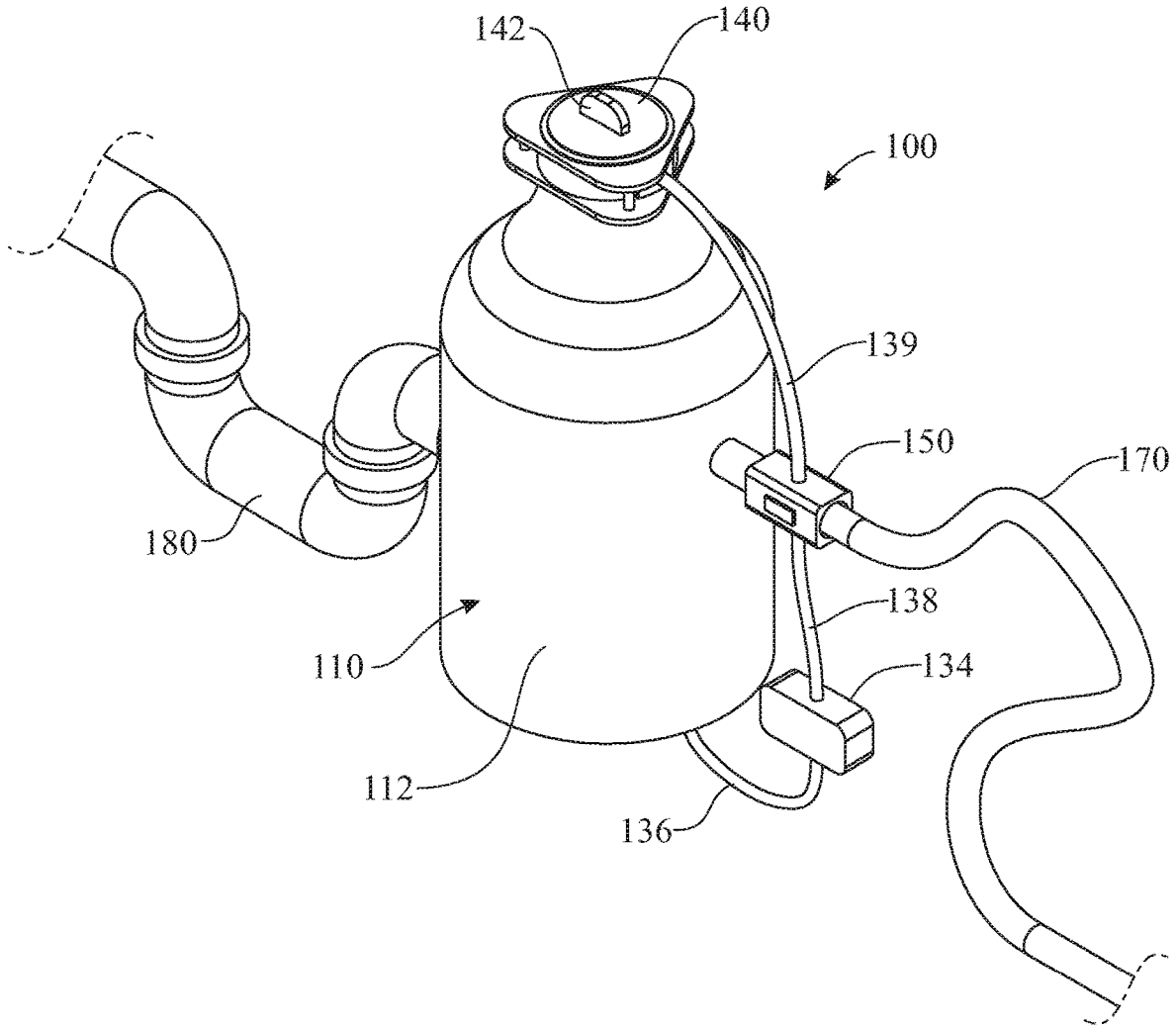
FIG. 3 presents a perspective view of the garbage disposal system of FIG. 1 in a second operational position in which the cap is arranged in a second rotational position.

The illustrations of FIGS. 3 and 5 show the garbage disposal system 100 in a second operational position in which the garbage disposal cap 140 is inserted into the container opening 114 and placed in a second rotational position (rotated 90 degrees clockwise or counterclockwise from the first position). In this second rotational position, the magnets 144 on the garbage disposal cap 140 face the corresponding reed switches 124 of the neck portion 116 of the container body 112, and the flow switch valve 150 detects (via the electrical wiring 139) that the garbage disposal cap 140 has been rotated to the second rotational position. Responsively, the garbage disposal cap 140 switches to an open position in which the flow switch valve 150 allows dishwasher water to be fed from the dishwasher drain hose 170 to the container 110, cleaning the container 110 and the cutting device 132 and washing away any residues. In this second operational position, the motor 130 can be switched on, causing the cutting device 132 to rotate and become more thoroughly washed by the dishwasher water. In different embodiments of the invention, when the garbage disposal system 100 is arranged in the second operational position or "cleaning mode", the garbage disposal cap 140 can block water from the sink so that the garbage disposal system 100 runs only with water from the dishwasher, or alternatively allow water from the sink to enter the container internal space 118.

In addition, different embodiments are contemplated regarding operation of the motor 130. In some embodiments, the motor 130 can be switched on by operating a user-operable switch as known in the art; thus, in addition to rotating the garbage disposal cap 140, the user must operate the user-operable switch to activate the motor 130 when desired. Alternative embodiments are contemplated in which the garbage disposal system 100 can operate the motor 130 in dependence of the position of the garbage disposal cap 140. For instance, it is contemplated that the motor 130 can switch on when the sensors described heretofore detect that the garbage disposal cap 140 is arranged in the second rotational position of FIG. 4; in other words, rotating the garbage disposal cap 140 can activate both the motor 130 and the feeding of dishwasher water via the dishwasher drain hose 170 through the flow switch valve 150, to guarantee that, in this "cleaning mode", optimum cleaning of the cutting device 132 is achieved. Further embodiments are contemplated in which the garbage disposal system 100 can include sensors for detecting that the garbage disposal cap 140 is arranged in the first rotational position of FIG. 4, and starting the motor 130 responsively. Further embodiments are contemplated in which the motor 130 is started in any rotational position of the garbage disposal cap 140, provided that the garbage disposal cap 140 is inserted to a given depth into the neck portion 116. In some embodiments, when the garbage disposal cap 140 is not inserted, the motor 130 does not operate. The garbage disposal cap 140 can thus be a safety cap to prevent accidental operation of the garbage disposal system 100.

Figure 6:
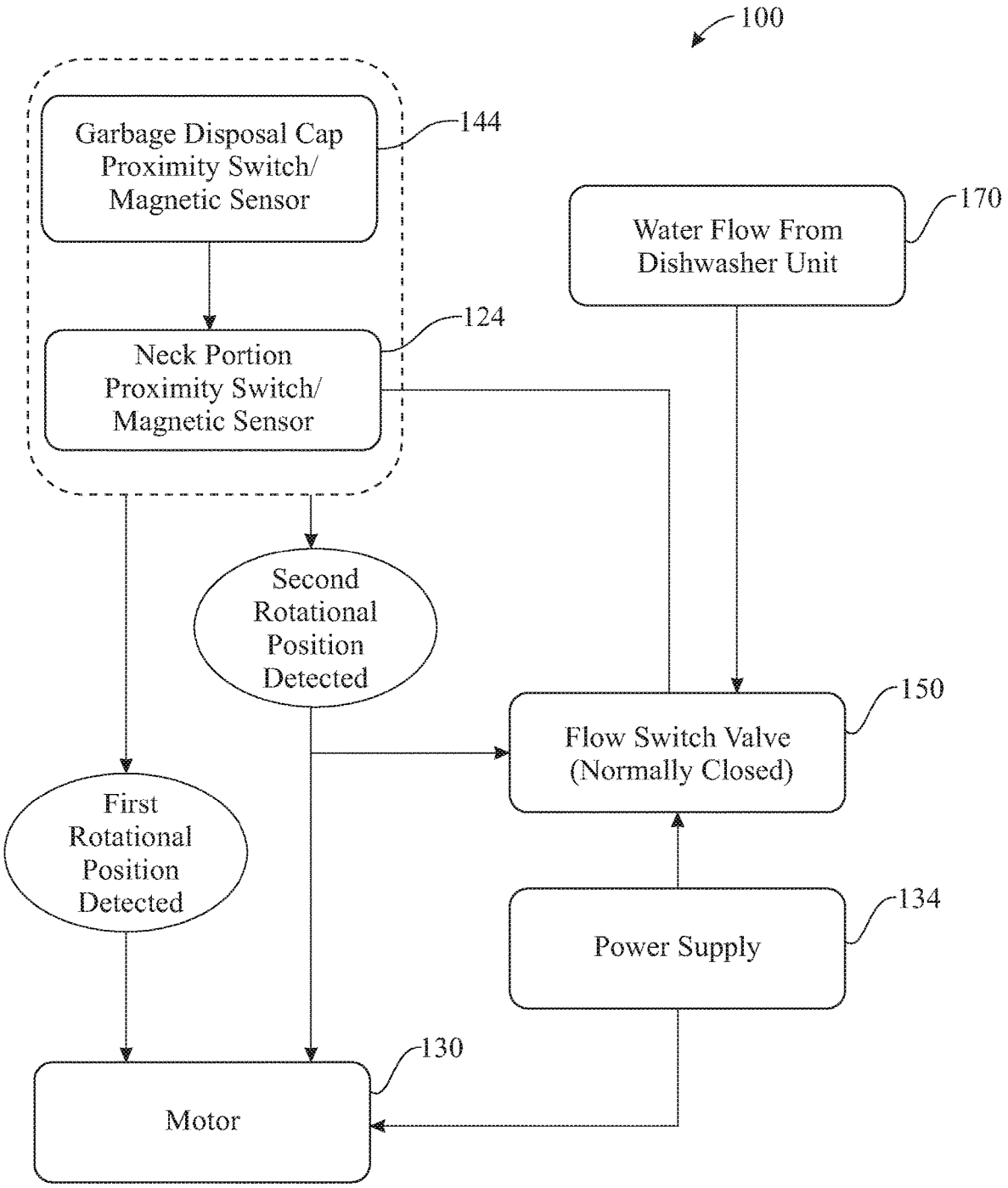
FIG. 6 presents a block diagram of the garbage disposal system of FIG. 1.

Referring now to FIG. 6, the garbage disposal system 100 of the present invention is illustrated diagrammatically using a block diagram. As shown, the garbage disposal cap 140 and the neck portion 116 of the container 110 can include proximity switches, magnetic switches or sensors or any other kind of sensors to detect a rotational position of the garbage disposal cap 140; for instance, the garbage disposal cap 140 and neck portion 116 can include one or more magnets 144 and corresponding reed switches 124, respectively, as described heretofore. When it is detected that the garbage disposal cap 140 is in the first rotational position (FIG. 4), the flow switch valve 150, which is normally closed, remains closed and the garbage disposal motor 130 will operate without water supplied from the dishwasher drain hose 170. When it is detected that the garbage disposal cap 140 is in the second rotational position (FIG. 5), the flow switch valve 150, which is normally closed, switches to an open position and the garbage disposal motor 130 will operate with water supplied from the dishwasher drain hose 170.

The garbage disposal system 100 of the present invention can be sold as an entirely new product to replace an existing, conventional garbage disposal system. Alternatively, the garbage disposal system 100 of the present invention can also be retro-fitted to an existing garbage disposal system; in other words, an existing garbage disposal system can be modified and converted into a garbage disposal system in accordance with the present disclosure. For example, sensors can be added to the neck portion of an existing garbage disposal container to interact with sensors on a provided garbage disposal cap. The added sensors can then be connected by an electrical wiring to a flow switch valve fitted to an end of the dishwasher drain hose. An inlet can be formed on the container and the flow switch valve can be communicated with the inlet via a tubing or hose.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A self-cleaning garbage disposal system, comprising:

a container having a container opening;

an electrically-operated cutting device housed in an internal space of the container and configured to cut waste entering the internal space through the container opening;

a flow switch valve operable to selectively allow or prevent fluid communication from a dishwasher drain hose to an inlet of the container, the flow switch valve being selectively and reversibly switchable to an open position allowing dishwasher water to be fed to the inlet of the container from the dishwasher drain hose and to a closed position to prevent dishwasher water from being fed to the inlet of the container from the dishwasher drain hose; and a garbage disposal cap configured to be inserted to the container opening; wherein the garbage disposal cap includes a user-operable switch for operating the flow switch valve and the electrically-operated cutting device.

2. The garbage disposal system of claim 1, wherein the container comprises a neck portion at which the container opening is located.

3. The garbage disposal system of claim 1, wherein the electrically-operated cutting device is configured to switch on and off in dependence of a position of the garbage disposal cap relative to the container opening.

4. The garbage disposal system of claim 1, wherein the garbage disposal cap is configured to allow water and waste to pass therethrough and into the internal space of the container when the garbage disposal cap is inserted into the container opening.

5. The garbage disposal system of claim 1, wherein the flow switch valve is switchable responsively to a rotational position of the garbage disposal cap within the container opening.

6. The garbage disposal system of claim 5, wherein the flow switch valve is switched to the open position responsively to the garbage disposal cap adopting a first rotational position relative to the container opening.

7. The garbage disposal system of claim 6, wherein the flow switch valve is switched to the closed position responsively to the garbage disposal cap adopting a second rotational position relative to the container opening, wherein the second rotational position is different to the first rotational position.

8. The garbage disposal system of claim 5, further comprising at least one sensor unit configured to detect the rotational position of the garbage disposal cap within the container opening.

9. The garbage disposal system of claim 8, wherein the at least one sensor unit comprises a first sensor portion located in the garbage disposal cap and a second sensor portion located in an area of the container adjacent to the container opening, wherein the first sensor portion is configured to mate with the second sensor portion to switch the flow switch valve.

10. The garbage disposal system of claim 9, wherein the first sensor portion and the second sensor portion are configured to switch the flow switch valve when the first and second portions are placed adjacent to one another.

11. The garbage disposal system of claim 9, wherein the container comprises a neck portion at which the container opening is located, and further wherein the second sensor portion is located in the neck portion of the container.

12. The garbage disposal system of claim 1, wherein the flow switch valve is normally in the closed position.

13. The garbage disposal system of claim 1, wherein the garbage disposal system is configured to adopt a working configuration in which the electrically-operated cutting device is switched to a cutting state and the flow switch valve is simultaneously in the open position, and fluid communication is allowed from the dishwasher drain hose, through the inlet of the container, along the electrically-operated cutting device and outwardly of the container through an outlet of the container.

14. The garbage disposal system of claim 1, wherein the garbage disposal system is configured to adopt a working configuration in which the electrically-operated cutting device is switched to a cutting state and the flow switch valve is simultaneously in the closed position, and fluid communication is allowed form the container opening, through the internal space of the container, along the electrically-operated cutting device and outwardly of the container through an outlet of the container.

15. A self-cleaning garbage disposal system, comprising:

a container having a container opening;

an electrically-operated cutting device housed in an internal space of the container and configured to cut waste entering the internal space through the container opening;

a flow switch valve operable to selectively allow or prevent fluid communication from a dishwasher drain hose to an inlet of the container, the flow switch valve being selectively and reversibly switchable to an open position allowing dishwasher water to be fed to the inlet of the container from the dishwasher drain hose and to a closed position to prevent dishwasher water from being fed to the inlet of the container from the dishwasher drain hose; and a garbage disposal cap configured to be inserted to the container opening; wherein the garbage disposal cap includes a user-operable switch for operating the flow switch valve and the electrically-cutting device.

16. A self-cleaning garbage disposal system, comprising:

a container having a container opening;

an electrically-operated cutting device housed in an internal space of the container and configured to cut waste entering the internal space through the container opening;

a flow switch valve operable to selectively allow or prevent fluid communication from a dishwasher drain hose to an inlet of the container, the flow switch valve being selectively and reversibly switchable to an open position allowing dishwasher water to be fed to the inlet of the container from the dishwasher drain hose and to a closed position to prevent dishwasher water from being fed to the inlet of the container from the dishwasher drain hose; and a garbage disposal cap configured to be inserted to the container opening; wherein the garbage disposal cap includes a user-operable switch for operating the flow switch valve and the electrically-operated cutting device; wherein the garbage disposal system is configured to adopt a first working configuration in which the electrically-operated cutting device is switched to a cutting state and the flow switch valve is simultaneously in the open position, and fluid communication is allowed from the dishwasher drain hose, through the inlet of the container, along the electrically-operated cutting device and outwardly of the container through an outlet of the container; and further wherein the garbage disposal system is configured to alternatively adopt a second working configuration in which the electrically-operated cutting device is switched to a cutting state and the flow switch valve is simultaneously in the closed position, and fluid communication is allowed form the container opening, through the internal space of the container, along the electrically-operated cutting device and outwardly of the container through an outlet of the container.

* * * * *